United States Patent [19]

Wenkman et al.

[11] Patent Number: 4,979,323

[45] Date of Patent: Dec. 25, 1990

[54] FRONT-LOADING DISPLAY FRAME

[75] Inventors: Gregory J. Wenkman, Middleton; Ferdinand F. Salzmann, Prairie du Sac, both of Wis.

[73] Assignee: Uniek Plastics, Inc., Madison, Wis.

[21] Appl. No.: 419,342

[22] Filed: Oct. 10, 1989

Related U.S. Application Data

[63] Continuation-in-part of Ser. No. 257,089, Oct. 13, 1988.

[51] Int. Cl.[5] ..... A47G 1/06; G09F 1/12

[52] U.S. Cl. ..... 40/152.1; 40/152; 40/154; 40/600; 40/611; 40/597

[58] Field of Search ..... 40/591, 152, 152.1, 40/312, 610, 611, 642, 490, 156, 154, 600, 597

[56] References Cited

U.S. PATENT DOCUMENTS

| | | | |
|---|---|---|---|
| 2,450,495 | 10/1948 | Ullman . | |
| 3,230,653 | 1/1966 | Rice | 40/591 |
| 3,415,407 | 12/1968 | Alden et al. | 40/312 |
| 3,496,665 | 2/1970 | Goldman | 40/591 |
| 3,601,916 | 8/1971 | Epstein | 40/610 |
| 3,623,254 | 11/1971 | Parish, Sr. | 40/591 |
| 4,016,664 | 4/1977 | Kaufman | 40/642 |
| 4,432,152 | 2/1984 | Daenen | 40/152.1 |
| 4,691,456 | 9/1987 | Ackeret | 40/490 |

FOREIGN PATENT DOCUMENTS

| | | | |
|---|---|---|---|
| 3002517 | 1/1980 | Fed. Rep. of Germany | 40/611 |

*Primary Examiner*—Kenneth J. Dorner
*Assistant Examiner*—J. Hakomaki
*Attorney, Agent, or Firm*—Quarles & Brady

[57] ABSTRACT

A frame (10) has an integral outer margin (24) and a back plate (26). A display item (28) such as a picture, photograph, certificate, document, or the like is front-loaded into the frame (10) by insertion of the corners of the display item (28) into slots (50). The display item (28) is thus held against the back plate (26) and bounded by the outer margin (24). A flexible transparent sheet (30) fits over the top of the display item (28) and is inserted into the slots (50) in like manner. The frame (10) has a bracket (44) such that the frame (10) may be mounted upon a horizontal surface such as a table, desk, counter or the like. The bracket may be inserted into different sockets (36), (38), (40), and (42) to change the orientation of the display item (28). The frame (10) may also be mounted upon a vertical surface such as a wall by use of either of holes (35), (37), (39), (41), depending upon the desired orientation of the display item (28) a magnet (64) or suction cup (68) may also be used for mounting upon other types of vertical surfaces.

14 Claims, 11 Drawing Sheets

FRONT-LOADING DISPLAY FRAME

CROSS-REFERENCE TO RELATED APPLICATION

This application is a continuation-in-part of application Ser. No. 07/257,089 filed Oct. 13, 1988.

FIELD OF THE INVENTION

This invention relates to frames used to mount and display pictures, photographs, certificates, documents, or the like.

BACKGROUND OF THE INVENTION

Picture frames are commonly used to mount, display, and protect pictures or documents. Most picture frames are comprised of an outside margin that borders the photograph or document, a transparent pane or sheet that fits within the outside margin and which serves to protect the photograph or document, and one or more back plates. The photograph or document is mounted by the removal of the one or more back plates, the insertion of the picture or document behind the transparent pane or sheet, the placement of the back plate over the backside of the picture or document, and the securing of the back plate in place. The transparent pane or sheet, the photograph or document, and the one or more back plates typically will fit into a recess in the outside margin. This assembly of the transparent pane or sheet, the picture or document, and the back plate are typically secured by wedging the assembly against the recess in the outside margin with some sort of fastener. The picture frame may then be displayed on a wall by attaching a length of wire to the side of the back plate not facing the picture or document and stringing the wire over a nail or other protrusion in a wall. Other means of hanging and displaying picture frames are well-known such as the use of hooks and/or holes.

The assembly of such frames and the subsequent mounting can be time-consuming. This is especially true where it is desired to replace one photograph or other display item with another, requiring removal and reassembly. Most of the frames of the prior art are typically expensive both to purchase and manufacture. These frames also require appropriate packaging to ship and to prevent from breaking.

The price and availability of photography has resulted in many people having many more photographs than they have means to display them. Often the cost of photograph frames is a factor in people choosing to display pictures or hide them in albums or collections. Therefore the availability of very economical photo frames would be of significant value to many people.

SUMMARY OF THE INVENTION

In accordance with the present invention, a rectangular picture frame has an integral outer margin and back plate. The front of the frame has four corners that are each slotted to receive a square picture or document corner. The four corners of the picture or document that is to be displayed are inserted into the four slotted corners, thus securing the picture or document in place and the outer margin thus forms an attractive border around the picture or document. The back plate which is an integral part of the outer margin gives rigidity and support to the picture or document. A transparent, flexible acetate cover sheet fits over the top of the photograph or document and also fits within the slotted corners to protect the photograph or document.

The picture or document in the frame may be displayed by hanging upon a wall, a refrigerator or other steal surface, or upon a mirror, window or other smooth, flat, vertical surface; the picture frame also may be set upon a table, counter, or other horizontal surface by means of a stand. There are four holes in the back plate that may be used to hang the frame upon a nail or hook in the wall with different orientations. A magnet mounted upon the side of the back plate that opposes the side used for display of the picture or document may be used to display the frame upon a refrigerator or other steel surface. In order to stand the frame upon a table, desk, counter, or other horizontal surface, a bracket may be fitted into one of four sockets on the side of the back plate that opposes the side used for display of the picture or document, each of the sockets being positioned along a length of the rectangular shape of the frame. The frame may therefore be hung, stood, or otherwise displayed according to the orientation of the picture or document.

The frame is thin-walled and may be inexpensively molded in one piece out of plastic. The frame is designed with stacking legs to allow shipping in stacks. The use of stacking legs minimizes scratching when the frames are shipped and eliminates the need for packaging.

Further objects, features, and advantages of the invention will be apparent from the following detailed description taken in conjunction with the accompanying drawings.

DESCRIPTION OF THE PREFERRED EMBODIMENT

Figure 1:
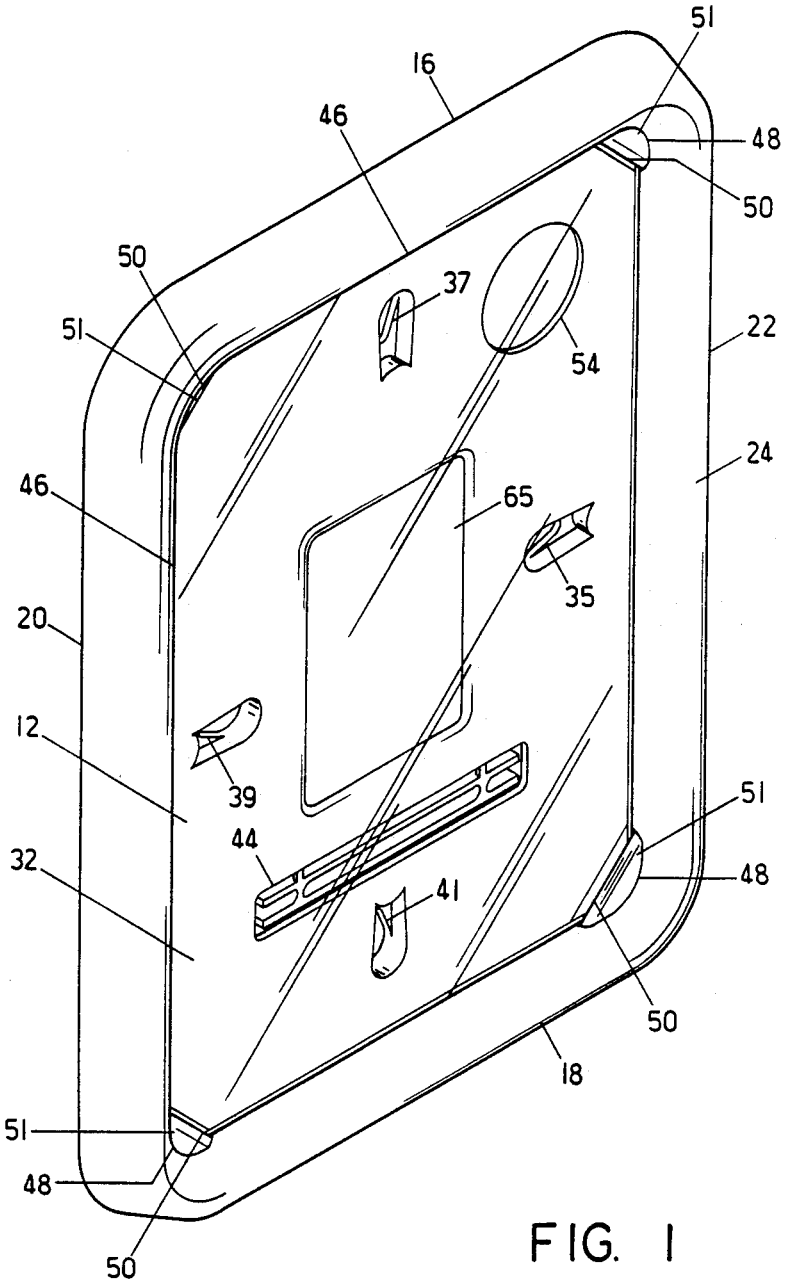
FIG. 1 is a perspective view of the frame of the present invention.
Figure 2:
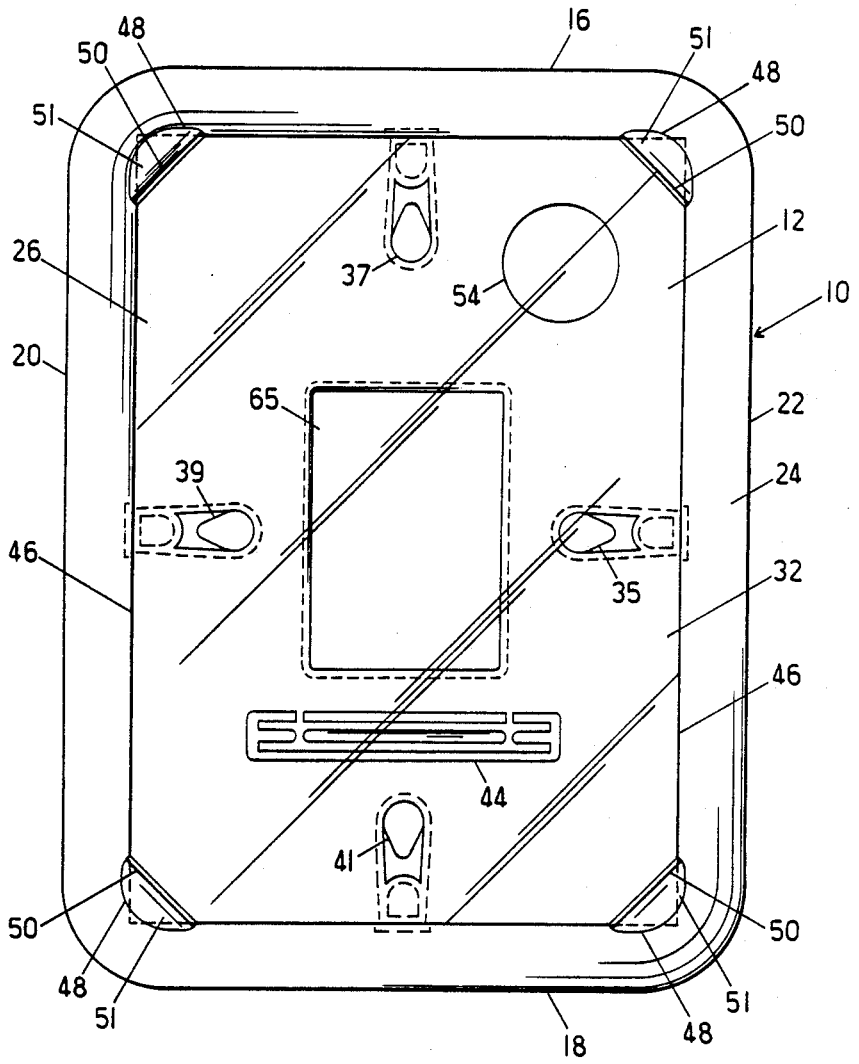
FIG. 2 is a front view of the frame of the present invention without the display item in place.

With reference to the drawings, a frame constructed in accordance with the present invention is shown at 10 in FIGS. 1–3. The frame 10 is preferably rectangular in shape and has a front 12, a back 14, a top 16, a bottom 18, and two opposing sides 20 and 22. The frame 10 has an outer display frame margin 24 and a centrally located back plate 26 that are integrally formed in a single piece, such as by a molding process. A display item 28 such as a picture, photograph, certificate, document, or the like is positioned within the outer frame margin 24 and against the back plate 26 so that the outer frame margin 24 forms a framed border for the display item 28 and the back plate provides rigid support for the display item 28. A transparent sheet 30 fits over the top of the display item 28 to protect it and hold it in place against the back plate 26. The back plate 26 has a front 32 and a back 34 analogous to the front 12 and the back 14 of the frame 10 itself. The back plate 26 has four tear-shaped holes 35, 37, 39, and 41, each of which is centrally located along the length of one of the sides of the rectangular shape of the frame 10 that are used to hang the frame 10 upon a nail, hook, or the like. The back plate 26 also has four sockets 36, 38, 40, and 42, each of which is also centrally located along the length of one of the sides of the rectangular shape of the frame 10. A bracket 44 may be insertable into any one of the four sockets 36, 38, 40, and 42 to act as a stand as the display frame may be positioned upright on a horizontal surface such as a desk, table, or counter with its longer axis either vertical or horizontal as desired. The bracket 44 may be inserted into any one of the four sockets 36, 38, 40, and 42, depending upon the desired orientation of the display frame 10.

Figure 8:
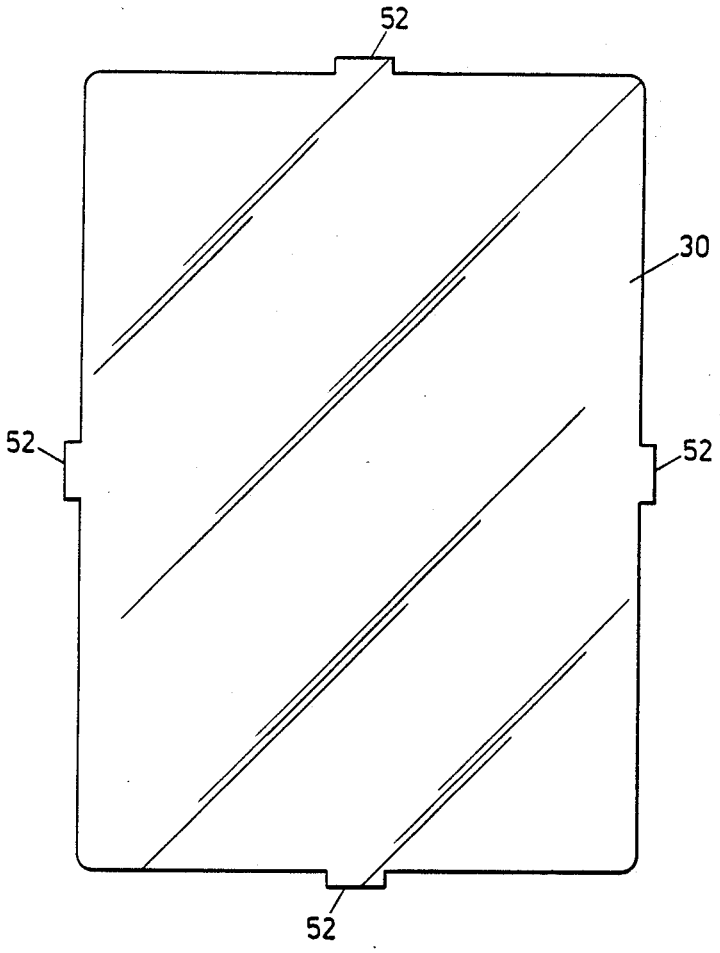
FIG. 8 is a front view of the protective sheet.

In the front 12 of the frame 10, the back plate 26 is recessed rearwardly from the outer margin 24 and the outer margin 24 has an inner surface 46 joined generally to the outer edge of the back plate 26. The back plate 26 is therefore recessed behind the frame border formed by the outer margin 24. The inner surface 46 is shaped to form corners 48. At each of the four corners 48, the inner surface 46 of the outer margin 24 has slots 50. The display item 28 is preferably rectangular, the length and width of the display item 28 being equal to or slightly less than the length and width of the front 32 of the back plate 26. To inset the display item 28 into the frame 10, the display item 28 is flexed to insert the corners of the display item 28 into the slots 50 at each of the corners 48. Extending inward from the outer margin 24 toward each of the slots 50 is a ledge 51. Each of the four ledges 51, at each of the corners of the back plate 26, is a planar sheet of plastic, parallel to the back plate, but spaced forwardly from it. The ledges 51 are thus generally triangular, although the apex of each triangle is rounded with the inside of the inside corner of the outer margin 24. The ledges 51 thus sit over the corners of the display item 28, and the transparent sheet 30, to hold them in place in the display frame. The display item 28 is thereby retained within the outer margin 24 and against the back plate 26 by the slots 50, the ledges 51, and by the bounds of the inside surface 46. The transparent sheet 30 is flexible and shaped rectangularly, the length and width of the transparent sheet 30 being equal to or slightly less than the length and width of the front 32 of the back plate 26. The transparent sheet 30 is inserted in the same manner as the display item 28, the transparent sheet fitting over the top of the display item 28 to serve as a means of protection. A suitable material for the transparent sheet 30 is clear polyvinyl chloride (PVC). Any other transparent sheet material, such as polyester sheeting, acetate sheeting or other polymer sheeting, is equally usuable. As shown in FIG. 8, the transparent sheet 30 may also incorporate ears 52 on its edge. The ears 52 are insertable into corresponding notches 53 which are indented in the inside surface 46 of the outer margin 24.

The back plate 26 has a hole 54 which communicates between the front 32 and the back 34 of the back plate 26. The hole 54 is large enough to accommodate a human finger. The finger may be inserted from the back 34 of the back plate 35 when it is desired to change the display item 28. The finger thus pushes against the display item 28 and withdraws the display item 28 from the slots 50 at least partially to assist the user in removal of the display item 28. The frame 10 of the present invention allows for ease of framing of the display item 28 by means of its front-loading of the display item 28, but also facilitates removal and replacement of the display item 28.

Figure 3A:
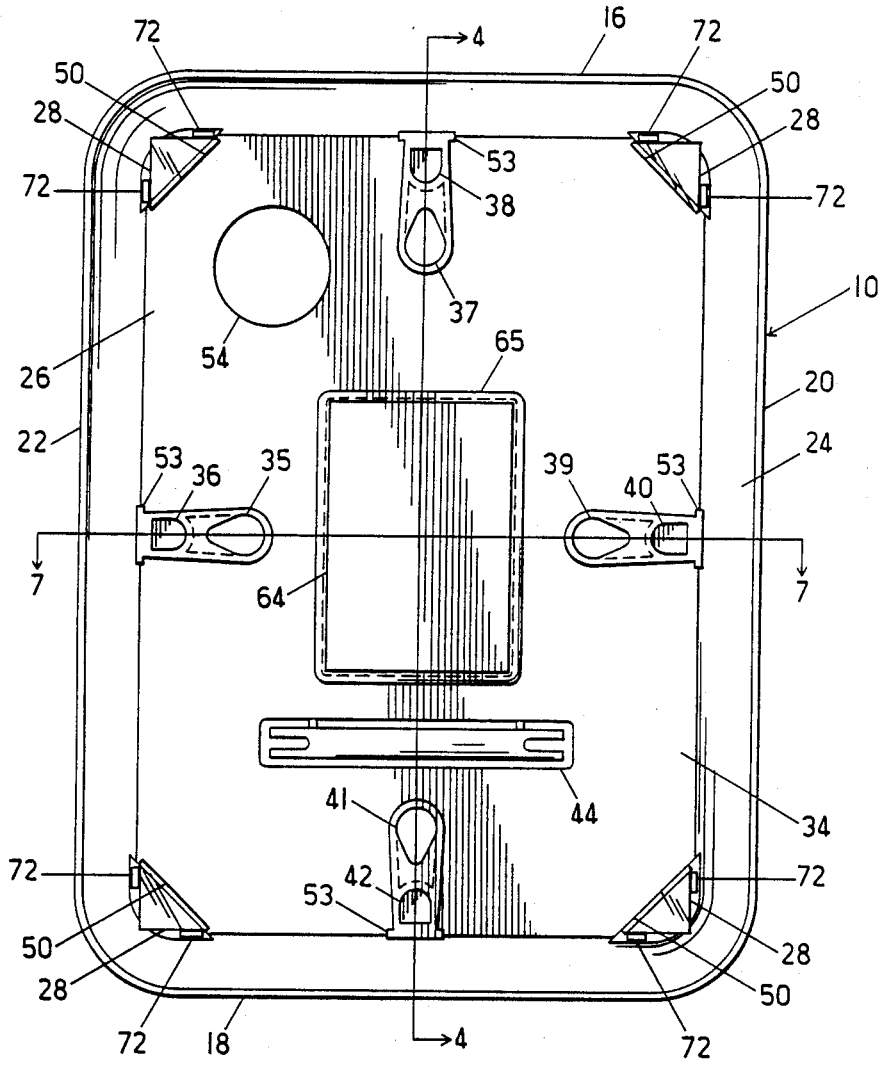
FIG. 3A is a back view of an embodiment of the frame having a magnet and with the display item in place.
Figure 3B:
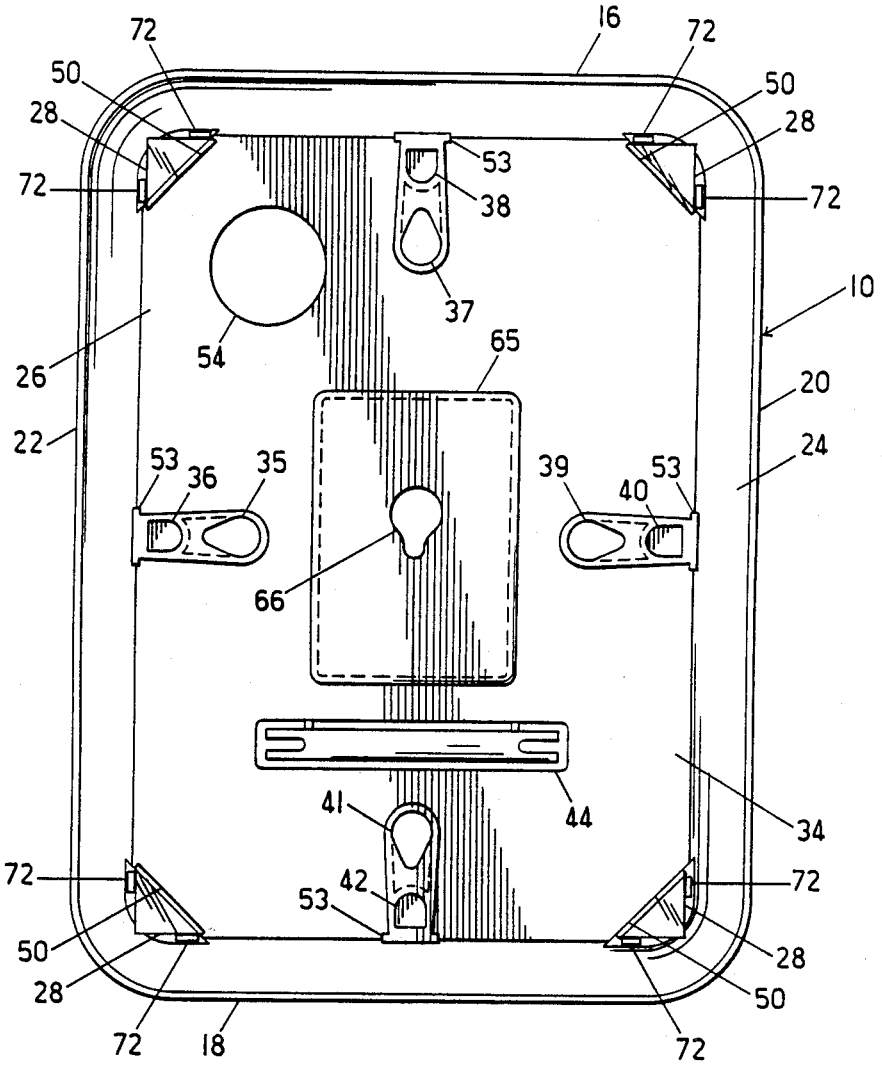
FIG. 3B is a back view of an embodiment of the frame having a keyhole adaptable to receive a suction cup and with the display item in place.
Figure 9:
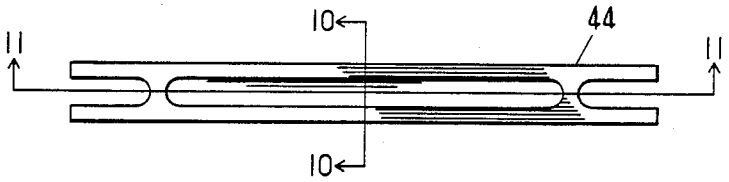
FIG. 9 is a bottom view of the bracket.
Figure 10:
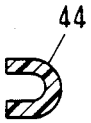
FIG. 10 is a cross-section take along line 10—10 of FIG. 9.
Figure 11:
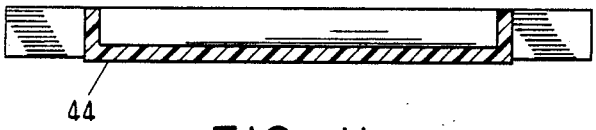
FIG. 11 is a cross-section taken along line 11—11 of FIG. 9.
Figure 13:
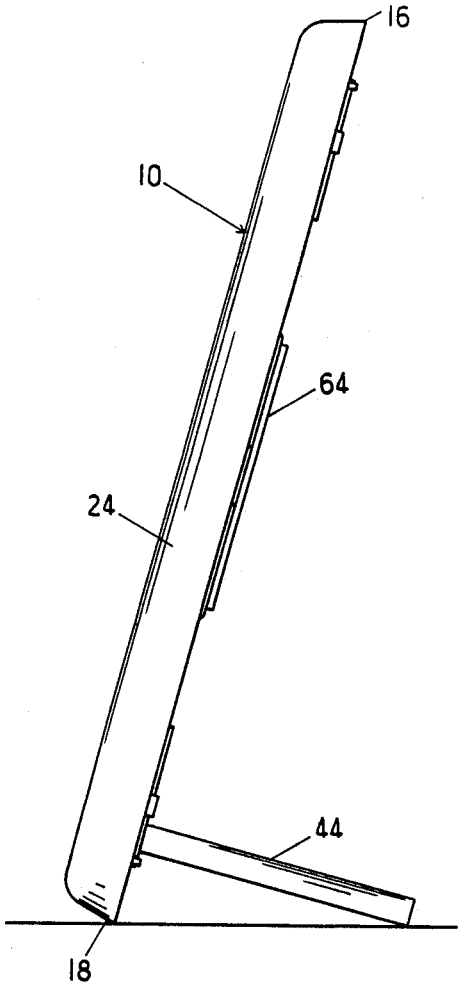
FIG. 13 is a side view as shown in FIG. 5, except that the bracket is inserted to form a stand.

As shown in FIGS. 3A and 3B, the bracket 44 is integrally molded with the frame 10 and may be easily pried from the back 34 of the back plate 26. FIGS. 9, 10, and 11 shown the bracket as it looks when liberated from the back 34 of the back plate 26. If desired to be stood upon a horizontal surface such as a table, desk, counter, or the like, the bracket 44 may then be inserted into one of the sockets 36, 38, 40, and 42. The sockets 36, 38, 40, and 42 are preferably D-shaped and receive the bracket 44, which is also D-shaped, in a press fit arrangement. The fit between the bracket 44 and either of the sockets 36, 38, 40, and 42 may optionally be a snap fit if designed such that the bracket 44 has a protrusion and the sockets 36, 38, 40, and 42 have a mating undercut. The bracket 44 may therefore be used as a stand in the mounting of the frame 10. FIG. 13 shows a side view of the frame 10 with the bracket 44 inserted into one of the sockets. The sockets 36, 38, 40, and 42 are each located along a length of the rectangular shape, thus enabling the frame 10 to be mounted with a horizontal orientation (as in sockets 36 and 40) or a vertical orientation (as in sockets 38 and 42).

Formed in the center of the back plate 26 is a rearwardly extending generally rectangular raised boss 65. Secured to the rear of the raised boss 65 is a thin planar rectangular magnet 64. The raised boss 65 is sized so that when the magnet 64 is secured to it, the rear surface of the magnet 64 is the rearmost portion of the entire display frame. This feature is necessary if the display frame is to be mounted on a large planar metallic surface, as is very desirable. A common place for such a display frame is on a home refrigerator, and the arrangement and position of the magnet permits the display frame to be magnetically attached to such a refrigerator. The magnet 64 thus must be strong enough to hold the display frame 10 in place. The magnet 64 is preferably secured to the raised boss by an adhesive.

Figure 12:
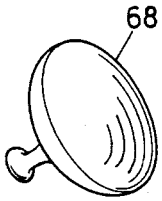
FIG. 12 is a perspective view of a suction cup that may be insertable into the keyhole as shown in FIG. 3B.

FIG. 3B shows an alternate embodiment in which a keyhole 66 is substituted for the magnet 64. In this embodiment, the keyhole 66 receives a suction cup 68 which may be used to then attach the frame 10 to a window, mirror, or other smooth surface. An example of a suction cup is shown in FIG. 12.

Figure 3C:
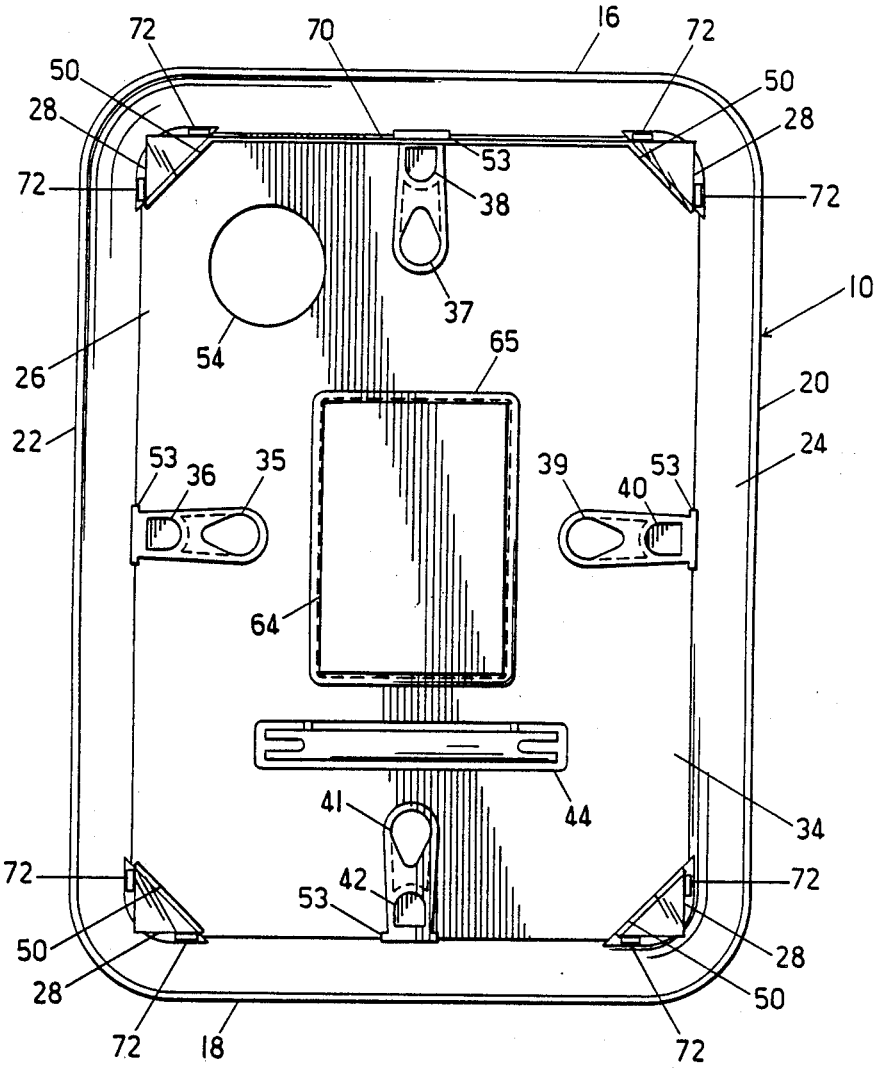
FIG. 3C is a back view of an embodiment of the frame having a magnet and with the display item in place and having a slit between two of the slots to accept an oversized display item.
Figure 3D:
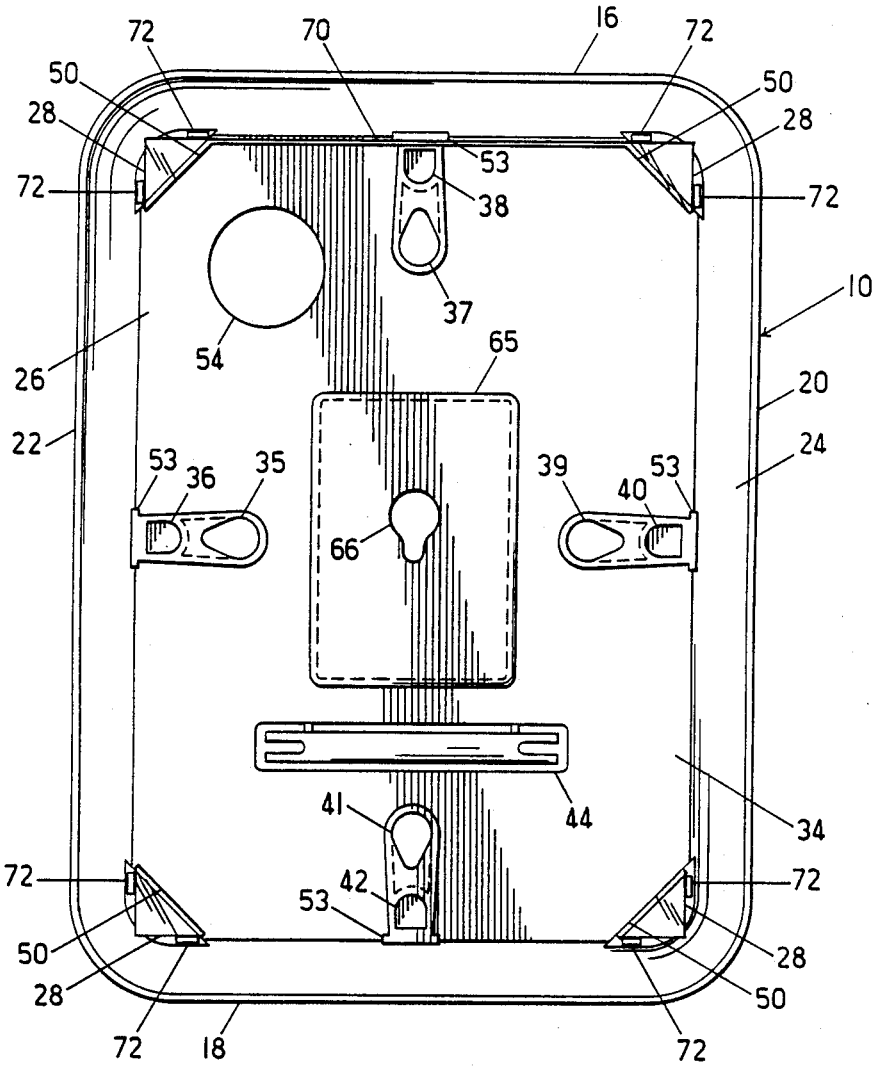
FIG. 3D is a back view of the frame having a keyhole adaptable to receive a suction cup and with the display item in place and having a slit between two of the slots to accept an oversized display item.
Figure 4:
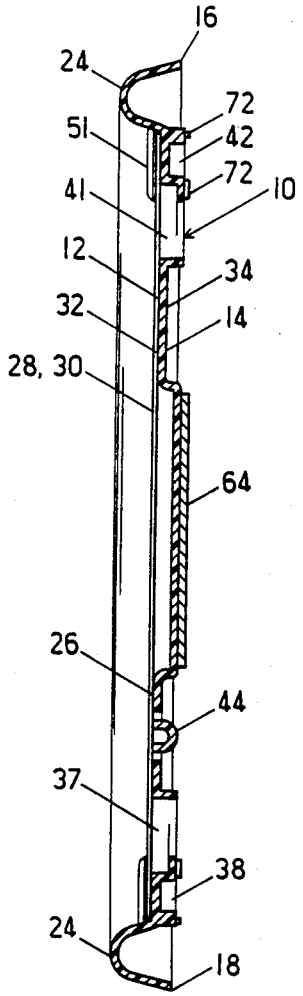
FIG. 4 is a cross-section taken along line 4—4 of FIG. 3, showing the bracket section as it is molded to the back plate and showing two of the holes by which the frame may be hung.
Figure 5:
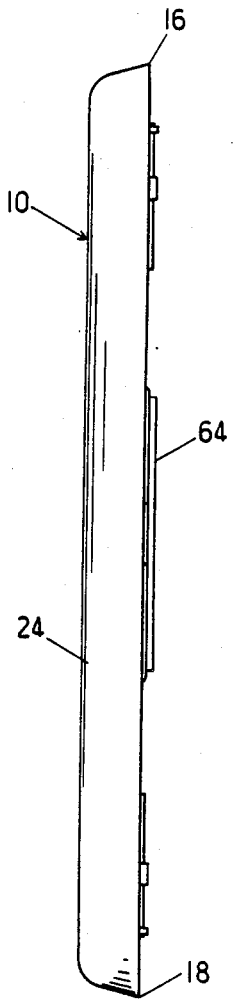
FIG. 5 is a side view of the frame.
Figure 6:
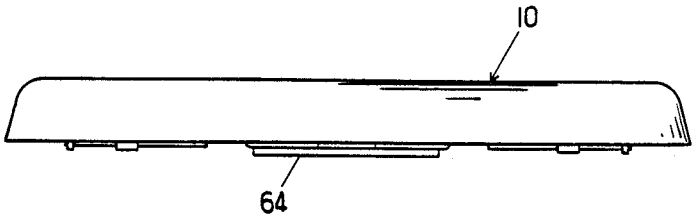
FIG. 6 is a top or a bottom view of the frame.
Figure 7:
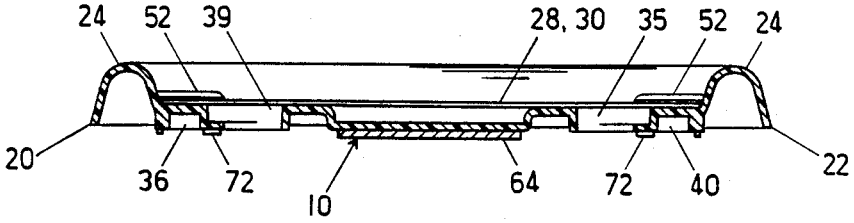
FIG. 7 is a cross-section taken along line 7—7 of FIG. 3, showing two of the holes by which the frame may be hung.

FIGS. 3C and 3D show alternate embodiments of FIGS. 3A and 3B. In these embodiments, the back plate 26 has a slit 70 across two of the slots 50. This allows a display item 28 to be mounted within the frame 10 such that the display item 28 may be oversized and hang over the slit 70 without a need to trim the length of the display item 28, yet still obscure the portion of the display item 28 which is hanging over behind the outer margin 24. The appearance of the display item 28 is therefore not unsightly and preserves intact the original appearance of the display item 28. The incorporation of the slit 70 may be adaptable whether or not a magnet 64 or suction cup is used, as reflected in FIGS. 3C and 3D.

The frame is thin-walled to minimize the material costs and to optimize the number of frames that can be stacked in a given space. In a picture display frame such as that disclosed here, economy of manufacture and shipping is a critically desired feature, and several features of the present display frame are intended to permit the easy and economical shipment and storage of the display frames, which contributes significantly to their economy.

Figure 14:
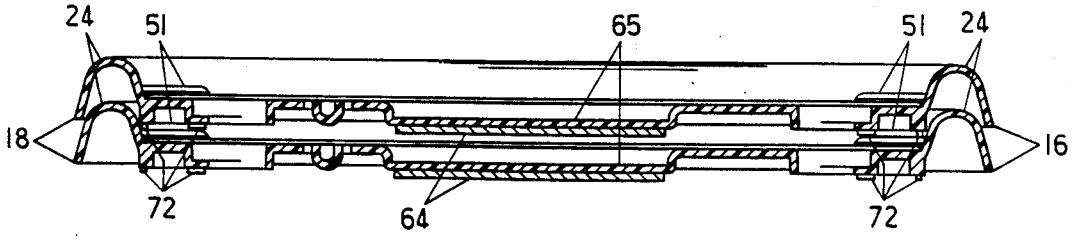
FIG. 14 is a cross-sectional view showing two display frames stacked one upon another.

One important feature contributing to this economy is the provision for stacking legs 72. There are two of the stacking legs 72, extending rearwardly, at each of the four corners of the rear of the back plate 26. The stacking legs 72 actually extend rearwardly from the ledges 51 and are positioned along the peripheral edge of the rectangle of the back plate 26 so as not to interfere with the display item 28 or the transparent sheet 30. The stacking legs 72 are of particular utility when display frames are stacked, as illustrated by the two display frames shown stacked in FIG. 14. The stacking legs 72 from one display frame rest on the front surface of the corresponding ledge 51 on the next display frame. The length of the legs 72 is selected so, essentially, only the stacking legs 72 touch the next frame. Since the legs 72 contact the ledge 51, and are restrained by the outer margin 24, no part can contact, or potentially scratch, the transparent sheet 30. Note also that since the raised boss 65 and magnet 64 are located in the center of the back plate 26, they can actually extend farther than the stacking legs 72, but they still will not contact the transparent sheet 30 on the next display frame since the legs 72 rest on the raised ledges 51.

This feature allows the display frames to be stacked and shipped without external wrapping or packaging without the frames scratching or marring adjacent frames. This ability contributes significantly to the overall economy of the frame as delivered to the retailer for sale to the ultimate consumer, a significant advantage for a product such as this.

It is understood that the invention is not confined to the particular construction and arrangement of parts herein illustrated and described, but embraces such modified forms thereof as come within the scope of the following claims.

What is claimed is:

1. A picture display frame molded in one piece comprising:

a generally rectangular back plate having a front and a back;

an outer frame margin surrounding the back plate and spaced forwardly therefrom, an inner surface of the outer margin generally joined to an outer edge of the back plate;

four ledges formed from the frame margin, one formed at each corner of the back plate, each ledge extending over a corner of the back plate and spaced forwardly therefrom so that the corners of a picture placed in the frame on the back plate will have its corners extending behind the ledges; and at least one leg extending rearwardly from the back of the back plate at each corner thereof, the leg at each corner located rearwardly of the ledge, the length of the legs selected so that when two of the picture frames are stacked one on top of the other, the legs of one picture frame will rest on the ledge of the other picture frame to hold the picture frames apart so that the picture frames can be shipped without exterior packaging and without the interior of the picture frames being in contact.

2. A picture display frame as claimed in claim 1 wherein there are two of the legs at each corner of the back plate.

3. A picture display frame as claimed in claim 1 wherein there is a slot through the picture frame at the margin of each ledge.

4. A picture display frame as claimed in claim 1 wherein there is a transparent planar sheet sized to fit within the picture frame and received with its corners behind the ledges, the legs further serving to prevent the rear portion of one picture frame from scratching the transparent sheet on the adjacent picture frame when they are stacked.

5. A picture display frame as claimed in claim 1 wherein: there are two of the legs at each corner of the back plate; there is a slot through the picture frame at the margin of each ledge; and wherein the legs are positioned at the peripheral edges of the ledges so as not to interfere with the extension of the corner of a picture through the slot and behind the ledge.

6. A picture display frame as claimed in claim 1 wherein there are mounting means on the back of the back plate to permit the picture frame to be mounted in a variety of orientations, the legs extending more rearwardly than the mounting means.

7. A picture display frame a claimed in claim 1 wherein the mounting means includes four holes, one located on each of the four sides of the rectangle back plate so that the picture frame can be hung in any of four orientations.

8. A picture display frame as claimed in claim 1 wherein the outer margin has an arcuate cross-section concave toward the rear of the picture frame, the concave side of the outer margin of one picture frame fitting over the convex side of another picture frame when the picture frames are stacked one on top of the other.

9. A picture frame molded in one piece comprising:

a generally rectangular back plate having a front and a back;

an outer margin surrounding the back plate and spaced forwardly therefrom, an inner edge of the outer margin generally joined to an outer edge of the back plate;

four ledges formed from the frame margin, one formed at each corner of the back plate, each ledge extending over a corner of the back plate and spaced forwardly therefrom so that the corners of a picture placed in the frame on the front of the back plate will have its corners extending behind the ledges so that the picture is retained in the picture frame;

a plurality of mounting means formed in the back of the back panel for mounting the picture frame in at least two possible orientations;

a plurality of legs extending rearwardly from the back of the picture frame, the legs arranged so as that when one picture frame is stacked on another, the legs hold the picture frames apart;

a raised boss extending rearwardly from the back of the back plate; and a planar magnet secured to the back of the raised boss, the raised boss and the magnet sized so that the magnet extends rearwardly beyond the mounting means and the legs so that the magnet is the most rearwardly extending part of the picture frame so that the magnet can be used to secure the picture frame to a planar metallic surface, the raised boss and the magnet also sized so that when one display picture frame is stacked upon another, the raised boss on one picture frame does not contact the other picture display frame.

10. A picture display frame as claimed in claim 9 wherein the boss and the magnet are generally rectangular.

11. A picture display frame as claimed in claim 9 wherein the legs are located behind the ledges so that when the picture frames are stacked one on top of another, the legs of one picture frame contact the ledge of the picture frame beneath so that the remaining portions of the picture frames are not in substantial contact so that minimal packaging of the picture frames during shipment is required.

12. A picture display frame as claimed in claim 11 wherein there are two of the legs behind each of the ledges.

13. A picture display frame as claimed in claim 9 wherein the magnet is adhesively secured to the back of the raised boss.

14. A picture display frame as claimed in claim 9 wherein there is a transparent planar sheet sized to fit within the picture frame and received with its corners behind the ledges so as to retain in place a picture placed behind it.

* * * * *